US005775832A

United States Patent [19]

Kilgrow et al.

[11] Patent Number: 5,775,832

[45] Date of Patent: Jul. 7, 1998

[54] COMPACT TIRE DEFLATOR

[76] Inventors: Donald C. Kilgrow, 164 W. 100 South, P.O. Box 848, Monticello, Utah 84535; Melvin H. Pederson, 161 E. 175 South, North Salt Lake, Utah 84054

[21] Appl. No.: 729,808

[22] Filed: Oct. 8, 1996

[51] Int. Cl.[6] ..... E01F 13/12

[52] U.S. Cl. ..... 404/6; 256/1

[58] Field of Search ..... 404/6, 9; 256/1, 256/13.1

[56] References Cited

U.S. PATENT DOCUMENTS

| | | | |
|---|---|---|---|
| 1,276,100 | 8/1918 | Niznik | 256/1 |
| 2,912,229 | 11/1959 | Persgard | 256/1 |
| 3,652,059 | 3/1972 | Groblebe | 256/1 |
| 4,097,170 | 6/1978 | Dickinson | 404/6 |
| 4,101,235 | 7/1978 | Nelson | 404/6 |
| 4,382,714 | 5/1983 | Hutchison | 404/6 |
| 4,544,303 | 10/1985 | Glasmire | 404/6 |
| 4,995,756 | 2/1991 | Kilgrow et al. | 404/6 |
| 5,116,326 | 5/1992 | Schmidt | 604/263 X |
| 5,253,950 | 10/1993 | Kilgrow et al. | 404/6 |
| 5,330,285 | 7/1994 | Greves et al. | 404/6 |
| 5,452,962 | 9/1995 | Greves | 404/6 |
| 5,482,397 | 1/1996 | Soleau | 404/6 |
| 5,498,102 | 3/1996 | Bissell | 404/6 |
| 5,507,588 | 4/1996 | Marts et al. | 256/1 X |
| 5,536,109 | 7/1996 | Lowndes | 404/9 X |
| 5,588,774 | 12/1996 | Behan | 404/6 |

FOREIGN PATENT DOCUMENTS

| | | |
|---|---|---|
| 593355 | 2/1984 | Germany . |
| 2032983 | 5/1980 | United Kingdom . |

OTHER PUBLICATIONS

Advertisement, "Hovey Hollow Spike Belt," Hovey Industries Ltd., 2793 Fenton Road, Gloucester, Ontario, Canada K1G 3N3.

Advertisement, "PRB Road Blocker," P.U.I. Company.

Advertisement, "Stop Stick," Stop Stick Inc., 2153 Picnic Lawn Drive #43, Lawrenceburg, Indiana 47025.

Advertisement, "A Portable Barrier Stops Vehicles," Sandra Paul, British Trade & Investment Office.

Advertisement, "Road Bloc 170," H.L.B. Security, Security Electronics Sales, Ltd., P.O. Box 5091, New York, New York 10163.

Advertisement, "Road Spikes," Sherwood International Export Corporation, Police Products Division, 18714 Parthenia Street, Northridge, California 91324.

*Primary Examiner*—James Lisehora
*Attorney, Agent, or Firm*—Madson & Metcalf

[57] ABSTRACT

A compact tire deflator is disclosed in one preferred embodiment of the present invention as comprising a compact housing member having a first panel pivotally disposed in relation to a second opposing panel by means of a pivotol engagement. In structure, the housing member comprises an internal surface area being sufficient for housing at least one spike mounting assembly further disposed in pivotal relation to the pivotal engagement. Preferably, the mounting assembly is formed having one or more hollow spikes removably disposed in relation to a compression sleeve which operably engages the bottom end of the hollow spike for introduction within a spike seat. A structural stop is preferably formed in relation to the first and second panels of the housing member and the spike mounting assembly to provide a means for maintaining the first and second panels at an angular disposition to the spike mounting assembly when the compact tire deflator is disposed in an open position. In this regard, the disposition of the first and second panels of the housing member provides a means for actuating a rocking motion when a pneumatic tire rolls on or over the first panel or the second panel, whereby the housing member cants towards the rolling tire thus directing the tip of one or more hollow spikes into the tire to allow the air retained therein to vent at a controlled rate of deflation.

23 Claims, 4 Drawing Sheets

COMPACT TIRE DEFLATOR

BACKGROUND

1. The Field of the Invention

This invention relates to tire deflation devices and, more particularly, to a novel compact tire deflator which provides for the controlled deflation of at least one pneumatic tire of a vehicle driven thereover.

2. The Background Art

From time to time, law enforcement officials have found it necessary to stop a vehicle operated by a person refusing an instruction or order to stop and, in addition, to further prevent a stopped vehicle from attempting an escape from its immediate detention. Traditionally, portable barricades have been positioned across a roadway by law enforcement officers to encourage one or more fleeing vehicles to stop. Prior art portable barricades may include, for example, heavy wooden or metal saw horses, motor vehicles (i.e., police cars) disposed bumper to bumper, or other suitable blocking mechanisms or means being sufficient to provide a rigid barrier to passage.

Unfortunately, the failure to provide a barricade having the inherent strength to facilitate a means of obstruction sufficient for deterring a vehicle from attempting to pass therethrough may ultimately result in serious physical damage, not only to the object or objects comprising the portable barricade, but may result in serious personal injuries to the driver and those in the immediate vicinity of the barricade. To alleviate the risk of physical damage and the potential of personal injuries to law enforcement officials, those skilled in the art developed prior art deflation devices capable of deflating the pneumatic tires of a fleeing vehicle without requiring a portable barricade of the type outlined above.

Two earlier U.S. Patents of the present inventors, U.S. Pat. Nos. 4,995,756 and 5,253,950, are directed to a such tire deflation device. These devices generally comprise an extendible support frame being preferably collapsible and including one or more rocker arms disposed in relation to the support frame. The rocker arms are preferably constructed having a means for mountably engaging one or more hollow spikes in removable relation therewith. In preferred design, the rocker arms are formed having a plurality of actuators that provide a means for pivoting the rocker arms when a tire engages one or more of the actuators so as to appropriately position at least one hollow spike (with or without an insert for penetrating a steel belted radial) into a pneumatic tire which is rolling thereover. Correspondingly, at least one hollow spike is preferably introduced into the tire thereby providing a controlled deflation of the tire.

Other tire deflation devices have also been developed by those skilled in the art. For example, prior art tire deflation devices were developed comprising an outer body formed of a collapsible material including a three-piece spike assembly embedded therein and disposed at various angular relationships to each other. In preferred operation, when a pneumatic tire rolls on or over the outer body of these prior art tire deflation devices, one or more of the spikes housed within the collapsible outer body typically emerge to puncture the tire.

Those skilled in the art further developed tire deflation devices comprising an electromechanical means for selectively and remotely activating a strip or array of spikes, relatively disposed in a modular frame, in order to raise the spikes into an upright position thus exposing the protruding tip of the spikes for the purpose of puncturing one or more tires of a vehicle passing thereover. Similarly, these prior art tire deflation devices typically provide a similar means for selectively and remotely deactivating the strip or array of spikes, thus providing a means for lowering the spikes into a downward position so that vehicles can safely pass thereover.

Although prior art tire deflation devices provide several advantages over the portable barricades of the prior art, several meaningful disadvantages still remain. For example, tire deflation devices of the prior art are typically bulky in dimensional size and may comprise numerous moving parts, whereby becoming inherently cumbersome in view of portability and storage. In particular, prior art tire deflation devices commonly consist of one or more collapsible frames having numerous structural features engageably disposed in relation therewith and are usually constructed in such a manner so as to provide an extendible means for covering the width of a lane of traffic or an entire roadway by using a single device or, in the alternative, by disposing a plurality of extendable frames in a connectable relationship across a roadway.

Consistent with the foregoing, the operational deployment of prior art tire deflation devices is usually awkward in regards to handling and often difficult to quickly or surreptitiously move as a result of their inherently large size and considerable weight. Consequently, law enforcement officers without a car will generally not have ready access to prior art tire deflation devices. Even those officers with a motorized vehicle having sufficient space for storing a prior art tire deflation device will typically need to have their vehicle near the desired deployment area in order to deploy the deflation device. In short, because prior art tire deflation devices generally require a considerable amount of surface area for storage, many law enforcement officers may not have ready access to these deflation devices when a situation arises for restricting the passage or movement of a vehicle.

Another significant disadvantage of prior art tire deflation devices is the intrinsic risk of sustaining serious personal injuries in association with contacting the sharp protruding ends of one or more spikes, if these devices are not handled carefully. To alleviate the inherent risk of injuries, custom-built housing assemblies were developed by those skilled in the art to provide a means for protecting a user from exposed spike tips. However, such protective measures typically consume additional storage space and are customarily more costly in relation to manufacturing costs Consistent with the foregoing, while the prior art tire deflation devices disclosed above appear generally suitable for their intended purposes, these tire deflation devices of the prior art nevertheless leave much to be desired from the standpoint of transportability, simplicity of construction, and safety in operation. As will be appreciated in the art, economic considerations are significant when dealing with the highly competitive law enforcement industry, since relatively complicated devices are frequently found to be commercially impractical. Accordingly, even a slight savings in the cost may substantially enhance the commercial appeal of a particular component or assembly when considering issues of mass production.

As illustrated by the number of prior patents and other disclosures, efforts are continuously being made in an attempt to provide a means for more efficiently deflating pneumatic tires. Correspondingly, none of these prior art disclosures suggest the present inventive system or combination of elements for a compact tire deflator as herein described and claimed.

BRIEF SUMMARY AND OBJECTS OF THE INVENTION

In view of the foregoing, it is a primary object of the present invention to provide a novel compact tire deflator which provides for the controlled deflation of at least one pneumatic tire of a vehicle driven thereover.

It is also an object of the present invention to provide a compact tire deflator which is inherently light-weight and conveniently portable.

Further, it is an object of the present invention to provide a compact tire deflator which is capable of protecting a user from personal injury as a result of being impaled by one or more spikes, irrespective of whether the compact tire deflator of the present invention is deployed for operation or retained for storage.

Similarly, it is an object of the present invention to provide a compact tire deflator which comprises a tip guard for protecting the respective tip of the hollow spikes.

It is also an object of the present invention to provide a compact tire deflator which can be immediately used without prior assembly.

Further, it is an object of the present invention to provide a compact tire deflator which can disable a vehicle regardless of the direction of travel.

It is still further an object of the present invention to provide a compact tire deflator which comprises a spike mounting assembly whereby the forces exerted by a vehicle tire rolling on or over one or more hollow spikes of the present invention will not deform the spike seat, thus protecting the support member wherein the spikes may be removably disposed.

In addition, it is an object of the present invention to provide a compact tire deflator which simplifies the tire deflating process, comprises few moving parts and is relatively trouble free in operation.

Consistent with the foregoing objects, and in accordance with the invention as embodied and broadly described herein, a compact tire deflator is disclosed in one preferred embodiment of the present invention as comprising a compact housing member having a first panel pivotally disposed in relation to a second opposing panel by means of a pivotal engagement. The housing member comprises an internal surface area sufficient for housing at least one spike mounting assembly disposed in pivotal relation to the pivotal engagement. In preferred construction, the spike mounting assembly may be formed having one or more hollow spikes removably disposed in relation to a compression sleeve adapted to received the bottom end of the spike and be disposed within a spike seat of the spike mounting assembly. In addition, a structural stop is formed between the first and second panels of the housing member and the spike mounting assembly to provide a means for supporting the first and second panels at an angular disposition to the spike mounting assembly when the housing member is disposed in an open position. In this regard, the angular disposition of the first and second panels provide a means for accommodating the actuation of a rocking motion of the compact tire deflator device of the present invention when a tire rolls on or over the first panel or the second panel.

In operation, the first and second panels of the housing member may be pivoted into an open position, thereby disposing at least one spike mounting assembly having one or more hollow spikes protruding therefrom in a substantially upward direction. When a pneumatic tire rolls on or over the first panel or the second panel, the housing member preferably cants towards the rolling tire, thus directing the protruding tip of one or more hollow spikes into the tire tread. After engaging the tire, one or more hollow spikes are removably released from the spike mounting assembly and preferably proceed to further puncture the tire as the tire continues to roll over the compact housing member. Correspondingly, the air retained within the pneumatic tire is allowed to vent through one or more hollow spikes engageably disposed therein.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 7, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
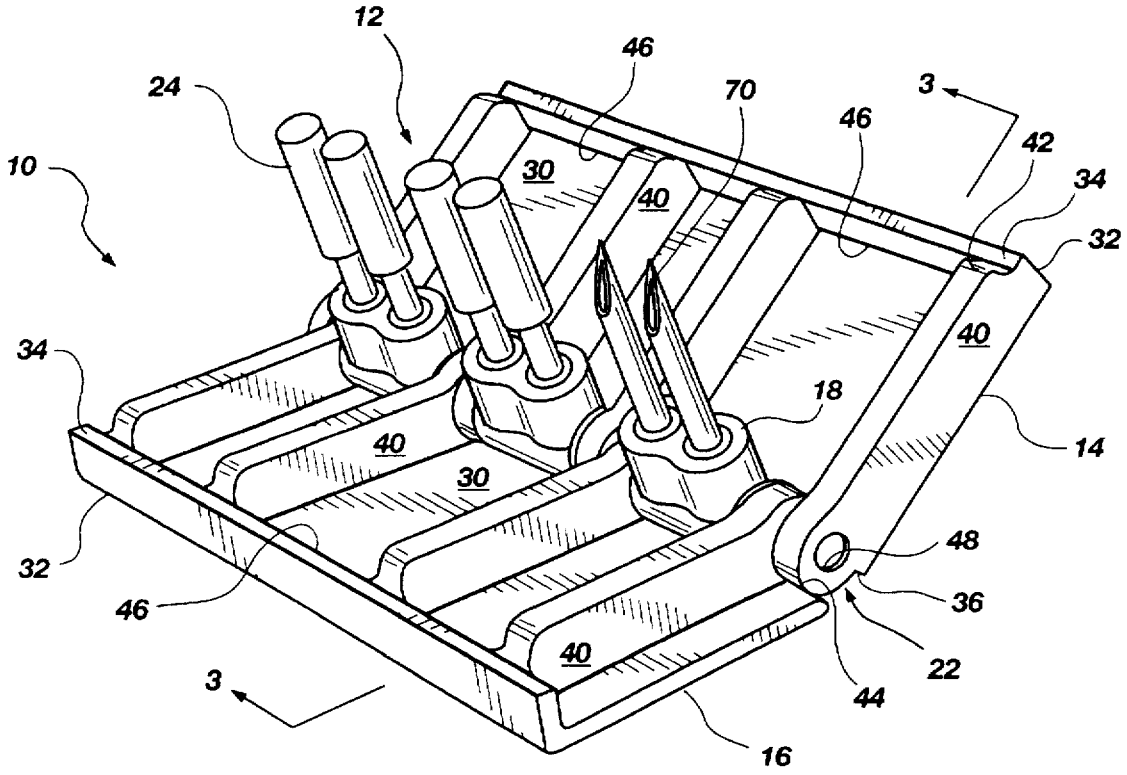
FIG. 1 is a perspective view of one presently preferred embodiment of a compact tire deflator.
Figure 3:
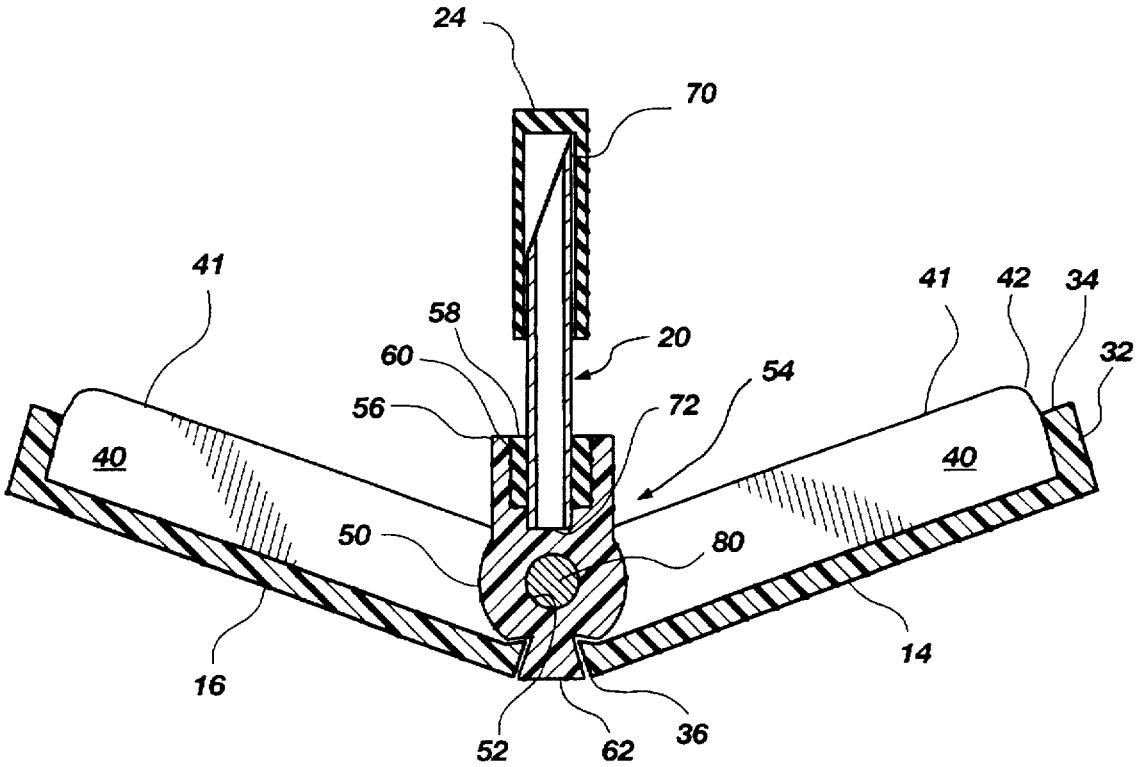
FIG. 3 is a cross-sectional view of the embodiment of FIG. 1 taken along lines 3—3 of FIG. 1.

One presently preferred embodiment of the present invention, designated generally at 10, is best illustrated in FIG. 1. As shown, a compact tire deflator 10 comprises a compact housing member 12 having a first panel 14 pivotally disposed in relation to a second opposing panel 16 by means of a pivotal engagement 22. In structure, the housing member 12 comprises an intermediate portion 30 providing an internal surface area being sufficient for housing at least one spike mounting assembly 18 further disposed in pivotal relation to the pivotal engagement 22. Preferably, the mounting assembly 18 is formed having one or more hollow spikes 20 removably disposed in relation to a compression sleeve 58 operably engaging the bottom end 72 of the hollow spike 20 for introduction within a spike seat 54, as best illustrated in FIG. 3.

A structural stop 36, 62 is preferably formed in relation to the first and second panels 14, 16 of the housing member 12 and the spike mounting assembly 18, respectively, to provide a means for maintaining the first panel 14 and the second panel 16 at an angular disposition to the spike mounting assembly 18 when the compact tire deflator 10 is disposed in an open position. In this regard, the disposition of the first and second panels 14, 16 of the housing member 12 provides a means for actuating a rocking motion when a pneumatic tire 96 rolls on or over the first panel 14 or the second panel 16, whereby the housing member 12 cants towards the rolling tire 96 thus directing the tip 70 of one or more hollow spikes 20 into the tire 96 to allow the air retained therein to vent at a controlled rate of deflation.

As best illustrated in FIG. 1, the housing member 12 comprises a first panel 14 and a second opposing panel 16 pivotally disposed in corresponding relationship by means of a pivotal engagement 22. In one presently preferred embodiment of the compact tire deflator of the present invention, the first panel 14 and the second panel 16 comprise several structural components and features which may be formed as a single, unitary panel. As will be readily appreciated by those skilled in the art, however, the utilization of a single, unitary panel is thus by way of illustration only and not by way of limitation.

In preferred construction, the first panel 14 and the second panel 16 are formed of a substantially sturdy, rigid material which provides sufficient structural integrity to the compact housing member 12 when a pneumatic tire 96 rolls on or over the housing member 12. For example, the first panel 14 and the second panel 16 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite materials are possible which are consistent with the spirit and scope of the present invention.

In one presently preferred embodiment of the present invention, because the structural relationship of the first panel 14 and the second panel 16 of the housing member 12 are relatively constructed having a substantially comparable configuration, only the first panel 14 will be operatively disclosed in detail herein. Correspondingly, the structural variations of the second opposing panel 16 as it relates to the first panel 14 will be further disclosed herein in order to distinguish the variations between the panels 14, 16.

Figure 5:
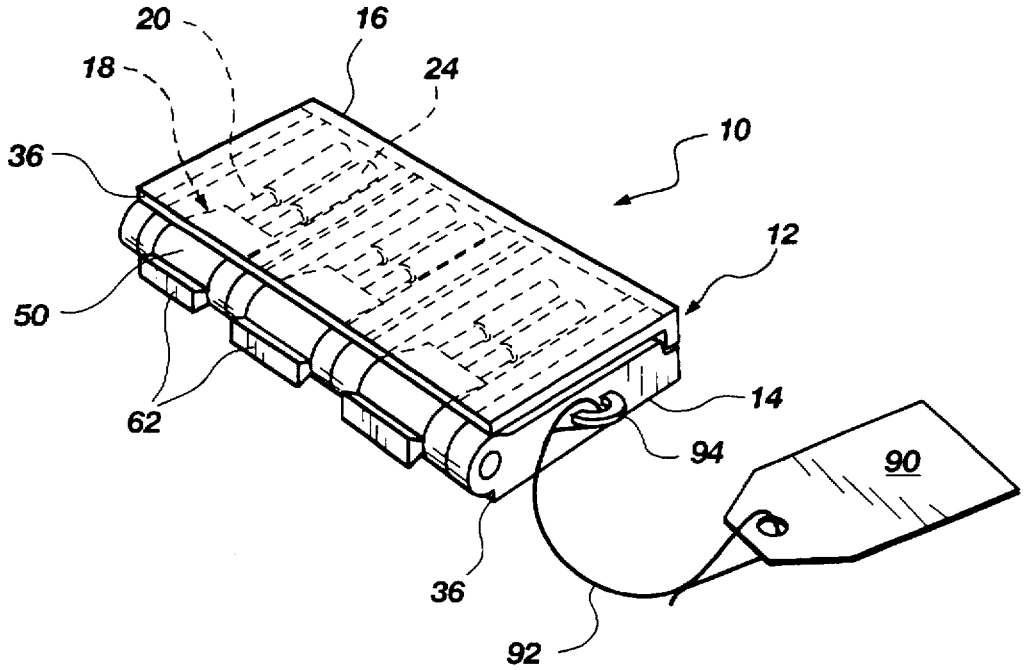
FIG. 5 is a perspective view of one presently preferred embodiment of the compact tire deflator pivotally disposed in a closed position.

Consistent with the foregoing, in one presently preferred embodiment of the present invention, the first panel 14 comprises a first side 32, a second opposing side 36, and an intermediate portion 30 disposed therebetween. As best shown in FIGS. 1, 3 and 5, the intermediate portion 30 of the first panel 14 is preferably formed having a substantially uniform thickness and comprising a substantially flat interior and exterior surface. Similarly, the interior and exterior surface of the intermediate portion 30 of the first panel 14 may be formed having a substantially smooth surface, which, as used herein, means that the surfaces are substantially free from roughness.

In structural design, longitudinally disposed along the first side 32 of the first panel 14 is a ridge 34. The ridge 34 may be disposed in rigid relation to the first side 32 of the first panel 14 and preferably extends substantially perpendicular to the intermediate portion 30 thereof. As best illustrated in FIG. 5, a ridge 34 may be formed on both the first panel 14 and the second panel 16 to provide a rigid engagement means between the first and second panels 14, 16 when the housing member 12 is pivotally disposed in a closed position. As will be appreciated, those skilled in the art will readily recognize other possible modifications and adaptations for providing an engagement means between the first panel 14 and the second panel 16 of the housing member 12 which are consistent with the spirit and scope of the present invention and contemplated herein.

Formed substantially parallel to the first side 32 of the first panel 14 is the second opposing side 36. Preferably, the second opposing side 36 comprises a leading edge having a dimensional height which is preferably consistent with the structural thickness of the intermediate portion 30 of the first panel 14. In preferred construction, the second side 36 of the first panel 14 provides a restrictive means which may pivotally engage a structural stop 62 formed in relation to the spike mounting assembly 18 thus supporting an angular disposition of the first panel 14 and the second panel 16 in relation to the mounting assembly 18 when the housing member 12 is disposed in an open position.

Figure 2:
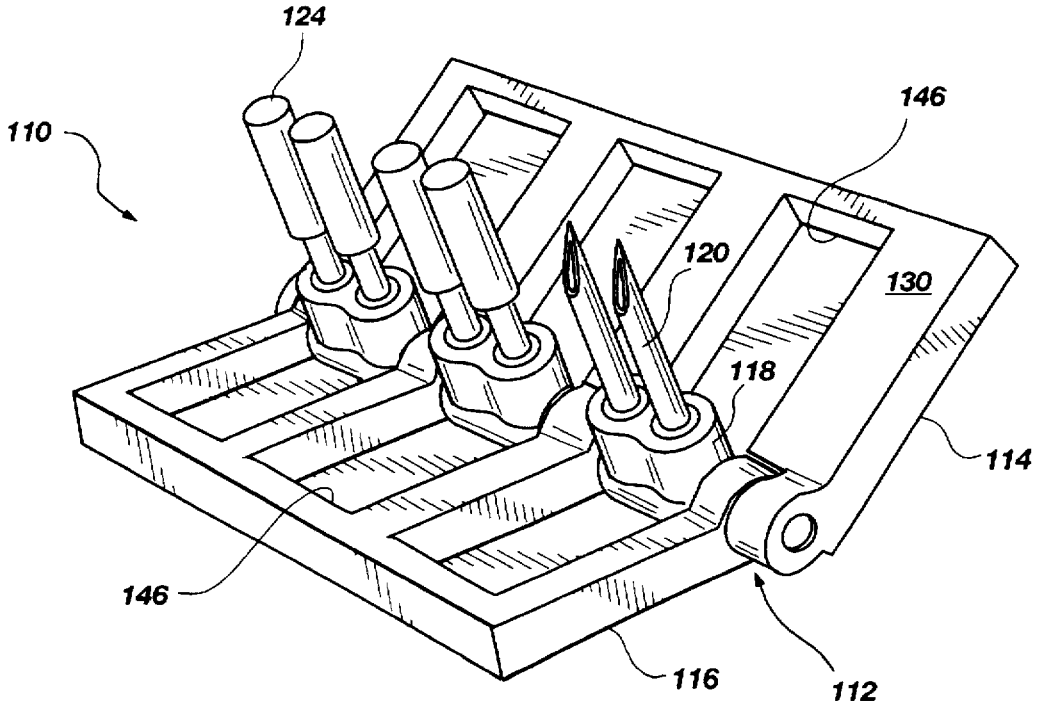
FIG. 2 is a perspective view of an alternate preferred embodiment of the compact tire deflator illustrating structural recesses formed in the interior surface of the first and second panels of the housing member which provide a means for housing at least one spike mounting assembly and one or more hollow spikes disposed in relation thereto.

In one presently preferred embodiment of the compact tire deflator 10 of the present invention, the first panel 14 of the housing member 12 comprises one or more structural ribs 40 disposed substantially perpendicular to the first side 32 and the second opposing side 36 of the first panel 14. In preferred design, a structural rib 40 includes a distal end 42 preferably engaging the ridge 34 at the first side 32 of the first panel 14. Further, the structural rib 40 includes a proximate end 44 which may extend slightly beyond the second opposing side 36 of the first panel 14 to allow for the pivotal movement of the first panel 14 in relation to the pivotal engagement 22. As best illustrated in FIGS. 1 and 2, the proximate end 44 of the structural rib 40 may comprise a substantially curvilinear configuration. A through-bore 48 may be formed at the proximate end 44 of the structural rib 40 to provide a means for engaging the pivotal engagement 22. Preferably, the through-bore 48 is formed having an internal diameter being sufficient for introducing a pivot pin 80 therein.

As shown, a plurality of structural ribs 40 may be disposed in rigid engagement with the interior surface of the intermediate portion 30 of the first panel 14. Substantially extending between the first side 32 and the second side 36 of the first panel 14, the structural ribs 40 provide a means for defining one or more internal cavities 46 in relation to the interior surface of the first panel 14. Similarly, an internal cavity 46 may be formed having an internal periphery comprising a sufficient dimensional surface area wherein at least one spike mounting assembly 18 and one or more removably mounted hollow spikes 20 may be pivotally disposed and removably housed when the housing member 12 is operably disposed in a closed position.

As realized by the inventive principles of one presently preferred embodiment of the compact tire deflator 10 of the present invention, an internal cavity 46 formed in the first panel 14 will preferably correspond with an internal cavity 46 formed in the second opposing panel 16, thus providing, in combination, an internal surface area sufficient for housing at least one spike mounting assembly 18 and one or more hollow spikes 20 removably disposed in relation thereto. Similarly, the structural ribs 40 disposed in relation to the intermediate portion 30 of the first panel 14 are preferably offset dimensionally in relation to the structural ribs 40 disposed in relation to the intermediate portion 30 of the second panel 16.

As illustrated in FIGS. 1 and 5, in one presently preferred embodiment, four structural ribs 40 may be disposed in rigid relation to the intermediate portion 30 of the first panel 14 and preferably formed in a spaced-apart relation to each other. Correspondingly, three internal cavities 46 are preferably provided in the first panel 14 which facilitate a means for housing at least three spike mounting assembly 18 and one or more hollow spikes 20 removably disposed in relation to each mounting assembly 18.

Referring now to FIG. 2, an alternate preferred embodiment of the present invention is shown which comprises one or more internal cavities 146 formed as structural recesses in the interior surface of the intermediate portion 130 of both the first panel 114 and the second opposing panel 116 of the housing member 112. In this regard, an internal cavity 146 formed in the intermediate portion 130 of the first panel 114 may be disposed in operative alignment with an internal cavity 146 formed in the intermediate portion 130 of the second opposing panel 116 thereby providing, in combination, an internal surface area sufficient for housing at least one spike mounting assembly 118 and one or more removably mounted hollow spikes 120 disposed in relation thereto, when the housing member 12 is disposed in a closed position.

Although the present invention is illustrated and described in connection with a first panel 14, 114 and a second opposing panel 16, 116 having a plurality of internal cavities 46, 146 formed therein, those skilled in the art will recognize that at least one internal cavity will be readily sufficient to provide sufficient means for housing one or more spike mounting assemblies 18, 118 having one or more removably mounted hollow spikes 20, 120 disposed in relation thereto. It is intended, therefore, that the examples provided herein be viewed as exemplary of the principles of the present invention, and not as restrictive to a particular structure for implementing those principles.

Similarly, those skilled in the art will recognize that the dimensional size of the compact housing member 12 may be formed having an internal space or cavity 46 sufficient to provide for housing a single spike mounting assembly 18 having one or more hollow spikes 20 removably disposed in relation thereto. Alternatively, the housing member 12 of the present invention may comprise an internal space or cavity 46 having a dimensional size sufficient to provide for housing a plurality of spike mounting assemblies 18 having one or more hollow spikes 20 removably disposed in relation thereto. Consistent with the foregoing, it is a principle feature of the present invention to provide a tire deflator 10 which is inherently compact in size, light-weight, and conveniently portable. In this regard, a presently preferred embodiment of the compact tire deflator 10 of the present invention comprises a housing member 12 preferably formed having a dimensional size such that the present invention may be hand-held and easily manipulated by a single user.

Referring now to FIGS. 1 and 3, the spike mounting assembly 18 is preferably disposed in contiguous relation to the second side 36 of the first and second panels 14, 16 of the housing member 12. As illustrated, at least one spike mounting assembly 18 is pivotally disposed in connection to the pivotal engagement 22 and preferably disposed between two structural ribs 40 of the first panel 14 and two structural ribs 40 of the second panel 16.

In construction, the spike mounting assembly 18 may be formed of a substantially sturdy, rigid material which provides sufficient structural integrity to avoid breakage when a pneumatic tire 96 rolls on or over the spike mounting assembly 18. For example, the spike mounting assembly 18 may be formed of any of numerous organic, synthetic or processed materials which are mostly thermoplastic or thermosetting polymers of high molecular weight with or without additives, such as, plasticizers, auto oxidants, extenders, colorants, ultraviolet light stabilizers, or fillers, which can be shaped, molded, cast, extruded, drawn, foamed or laminated. It will be readily appreciated by those skilled in the art, however, that a wide variety of other suitable materials such as, metal or metal alloys, fiberglass, wood, ceramic, graphite and/or other composite materials are possible which are consistent with the spirit and scope of the present invention.

In one presently preferred embodiment of the present invention, the compact tire deflator 10 comprises a plurality of spike mounting assemblies 30 adapted to be pivotally disposed in relation to the pivot pin 80 of the pivotal engagement 22. As best shown in FIG. 3, the spike mounting assembly 30 comprises a substantially cylindrical base 50 having an opening 52 formed therein. The opening 52 integrally disposed in the base 50 of the spike mounting assembly 18 is preferably formed having an internal diameter sufficient for introducing the pivot pin 80 therein. In operative function, the disposition of the pivot pin 80 in relation to the opening 52 formed in the support base 50 provides a means for pivoting the spike mounting assembly 18 in relation to the pivotal engagement 22.

Integrally formed in structural relation to the base 50 of the spike mounting assembly 18 is a spike seat 54 comprising at least one spike base boss 56 providing a channel which is preferably long enough in axial dimension to supportably engage at least one hollow spike 20. In one presently preferred embodiment of the present invention, the spike seat 54 may be formed having at least two spike base bosses 56 relatively disposed to provide a means for supportably engaging a hollow spike 20 projecting substantially upward from each spike base boss 56, as best illustrated in FIGS. 1, 2 and 3.

Formed in each spike seat 54, a channel is drilled or otherwise formed to provide a spike base boss 50 which extends substantially upward structurally from the base 50 of the spike mounting assembly 30. The drilling, or similar operation, produces a channel having an internal diameter sufficient for introducing the bottom end 72 of a hollow spike 20. The channel formed at the surface of the spike base boss 56 may be countersunk to a greater diameter in order to form a compression sleeve seat 60. Preferably, the compression sleeve seat 60 is provided for accommodating a compression sleeve 58 in a fitted relationship thereto.

In preferred design, the spikes 20 are hollow metal tubes that each have one end sharpened to a point to provide a tip 70, with the other tube end 72 being substantially flat, as shown best in FIG. 3. The straight open passage through the hollow spikes 20, when embedded in a tire 96, provide a means for venting the air from the tire 96, thus providing a controlled means of deflation to where a vehicle operator can safely stop his vehicle prior to when the tire 96 is fully deflated. As will be appreciated by those skilled in the art, the hollow spikes 20 can be of any convenient size, and could even comprise hypodermic needles, or the like, as anticipated within the scope of this disclosure. Each spike 20 may be arranged for seating in the spike base boss 56 of the spike seat 54. As contemplated by the present invention, any sufficiently rigid material being capable of comprising a sharp tip may be used to construct a hollow spike 20. For example, in one presently preferred embodiment of the present invention, the hollow spikes 20 are formed of stainless steel.

In an alternate preferred embodiment of the present invention, the hollow spike 20 may be formed to further include an insert (not shown) designed for puncturing a steel belted tire. The insert preferably consist of a section of metal, such as a hard steel, as for example a 4140 steel, tungsten steel, or like hard material. The section of hard material may be bent serpentine to have a corrugated appearance, or has been otherwise formed to resist bending, such as into a star configuration, or the like. An insert is thereby provided that will resist bending without closing of the passage through the hollow spike 20 wherein it is fitted, and which insert end is formed into a sharp end. The sharp end of the insert, when the insert is fitted in the hollow spike 20, will extend beyond the tip 70 of the hollow spike 20. To maintain the insert in the hollow spike 20, the bottom end of the insert is centrally longitudinally slotted and the insert end sections so formed are bent oppositely, at right angles to the insert longitudinal axis, into feet that extend across the bottom end 72 of the hollow spike 20. If such an insert is incorporated into the tire deflator device 10 of the present invention, the feet of the insert preferably reside in the channel formed in the spike seat 54 adjacent the bottom end 72 of the spike 20.

In relation to the hollow spike 20, a compression sleeve 58 may be removably fitted over the bottom end 72 of the spike 20, thus exposing enough of the bottom end 72 of the hollow spike 20 to fully seat the spike 20 in the spike base boss 56. With the compression sleeve 58 operatively disposed in relation to the bottom end 72 of the hollow spike 20, both the hollow spike 20 and its accompanying compression sleeve 58 preferably fit snugly within the channel comprising the spike base boss 56, wherein the compression sleeve 56 is preferably disposed in relation to the compression sleeve seat 60 while the bottom end 72 of the spike 20 is preferably disposed slightly below the contacting periphery of the compression sleeve 58 to fully seat the spike 20 in relation to the spike base boss 56.

In one presently preferred embodiment of the present invention, the compression sleeve 58 is formed of any of various resilient substances capable of withstanding shock without permanent deformation. For example, the compression sleeve 58 may be formed of a resilient material such as, 60 durometer rubber, an elastomeric thermal vulcanizing plastic, etc. As will be readily appreciated by those skilled in the art, other suitable resilient materials are possible which are consistent with the spirit and scope of the present invention.

Consistent with the foregoing, the compression sleeve 58 provides a suitable means for selectively deflecting the hollow spike 20 in response to a deflection of the spike in a transverse direction, which may otherwise cause the bottom end 72 of the hollow spike 20 to disfigure the structural shape of the spike base boss 56 of the spike seat 54. In particular, a pneumatic tire 96 engaging the first panel 14 or the second opposing panel 16 of the housing member 12, tends to cant at least one spike mounting assembly 18 and one or more hollow spikes 20 removably disposed in relation thereto, thus the force of the tire 96 acting against the spike 20 may be transmitted to and absorbed by the compression sleeve 58 removably fitted in engagement therewith, without deforming the walls of the spike seat 54. Pursuant to this preferred arrangement, the spike seat 54 of the spike mounting assembly 18 may be easily refilled with hollow spikes 20 and the compact tire deflator 10 reused.

In addition to the compression sleeve 58, the hinge pin 80 disposed in relation to the first panel 14, second panel 16, and the spike mounting assembly 18 is preferably formed of a sufficiently rigid material which provides sufficient structural integrity to support the hollow spikes 20 from deforming the base 50 of the spike mounting assembly 18 and the housing member 12, in general. In one presently preferred embodiment of the present invention, the hinge pin 80 may be formed of aluminum. It will be appreciated, however, that other sufficiently sturdy, rigid materials are possible.

To protect the tip 70 of the hollow spike 20, a tip guard 24 may be provided. The tip guard 24 is preferably disposed over an upper portion of a hollow spike 20 to provide a means for protecting the user of the present invention from physical injury as a result of contacting the sharp end or tip 70 of the spike 20. Additionally, if the present invention is dropped or thrown by a user, a spinning tire, etc., the tip guard 24 may serve to protect the tip of the hollow spike 20 from damage.

In preferred structural design, the tip guard 24 is formed as an elongated tubular member having an open end, an opposing closed end, and a hollow intermediate section disposed therebetween. The intermediate section of the tip guard 24 preferably comprises an internal diameter which is slightly larger than the outer diameter of the upper portion of the hollow spike 20, thus providing a means for introducing the tip guard 24 sufficiently snug thereover.

The tip guard 24 is preferably formed of a material which is sufficiently pierceable by the sharp tip 70 of the hollow spike 20 such that when a tire 96 engages the spike 20, the weight of the tire 96 may force the tip 70 of the hollow spike 20 to pierce the closed end of the tip guard 24, thereby exposing the tip 70 of the spike 20 for puncturing the tire 96. In this regard, the tip guard 24 is preferably formed of a resilient material being sufficiently pierceable by the sharp tip of a spike 20. For example, the tip guard 24 may be formed of a 60 durometer rubber, an elastomeric thermal vulcanizing plastic, etc. It will be readily appreciated by those skilled in the art that other suitable elastomeric or resilient pierceable materials are possible.

Referring now to FIG. 5, the housing member 12 of the present invention is shown in a closed position. As illustrated, the first panel 14 and the second opposing panel 16 provide a means for housing at least one spike mounting assembly 18 and one or more hollow spikes 20 removably disposed in relation thereto. Further, the engageable relationship of the structural ribs 40 and the contacting ridges 34 of the first panel 14 and the second panel 16 of the housing member 12 are readily disclosed. Moreover, the structural relationship of the structural stop 62 of the spike mounting assembly 18 and the second sides 36 of the first and second panels 14, 16 are readily illustrated in operative correlation for demonstrative purposes.

For convenience, if desired, an attachment member 94 may be disposed in relation to housing member 12 to provide a means for attaching a lanyard 92 to the compact tire deflator 10. The lanyard 92 may be utilized to facilitate a means for attaching a variety of tags 90 or, in the alternative, to enable a user to more easily transport or engage the present invention. As indicated in relation to the tip guard 24, a spinning vehicle tire 96 may cause the compact tire deflator 10 to be thrown. As a safety precaution to avert potential harm or danger to persons, the lanyard 92 may be utilized to secure the compact tire deflator 10 to a fixed article such as, for example, a parking meter, light pole, etc. so that if thrown, the present invention will remain within the approximate area of its deployment which will inherently depend on the overall length of the lanyard or cordage.

Figure 6:
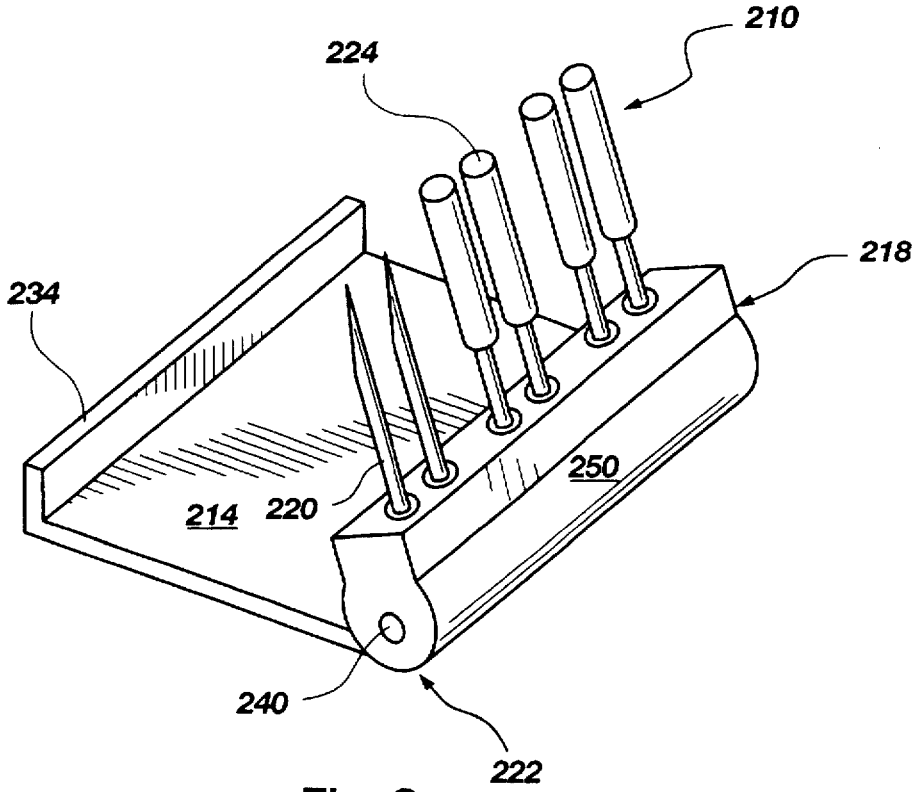
FIG. 6 is a perspective view of an alternate preferred embodiment of the compact tire deflator comprising only one side panel and a unitary spike mounting assembly having a plurality of hollow spikes removably disposed in relation thereto.

As illustrated in FIG. 6, an alternate preferred embodiment of the compact tire deflator 210 of the present invention comprises a panel 214 having a substantially flat intermediate portion disposed between a first side and a second opposing side which provides a sufficient surface area for pivotally introducing the spike mounting assembly 218 and one or more hollow spikes 220 removably extending therefrom. The first side of the panel 214 is preferably formed having a ridge 234 disposed substantially parallel thereto. Although not shown, the second side of the panel 214 preferably includes a means for pivotally engaging the pivot pin 280 of the pivotal engagement 222.

Further disposed in pivotal relation to the pivot pin 28O is a spike mounting assembly 218 having one or more hollow spikes 220 disposed in removable relation thereto. In pivotal disposition, the spike mounting assembly 218 comprises a base 250 having an opening formed therein for engageably introducing the pivot pin 280 therethrough. Preferably, the spike mounting assembly 218 supports a plurality of hollow spikes 220 which extend substantially outward therefrom.

In the alternate embodiment of the compact tire deflator 210, the panel 214 is not angularly disposed in relation to the spike mounting assembly 218, rather the mounting assembly 218 is supportably canted into a position which provides an angular disposition of the hollow spikes 220. In this regard, the angular disposition of the spikes 220 facilitates a means for deflating a pneumatic tire when the tire rolls on or over the panel 214 thereby engaging one or more of the hollow spikes 220. Moreover, the spike mounting assembly 218 may be disposed in a fixed angular relation to the panel 214, thus providing no pivotal movement or tilting action in relation therebetween.

As will be readily appreciated, however, the functional operation of this alternate embodiment is dependent on the direction of the rolling tire to provide a means for sufficiently disabling a vehicle. As apparent from the several embodiments included herein, a compact tire deflator may be constructed comprising other possible modifications and adaptations which are consistent with the spirit and scope of the present invention.

Figure 7:
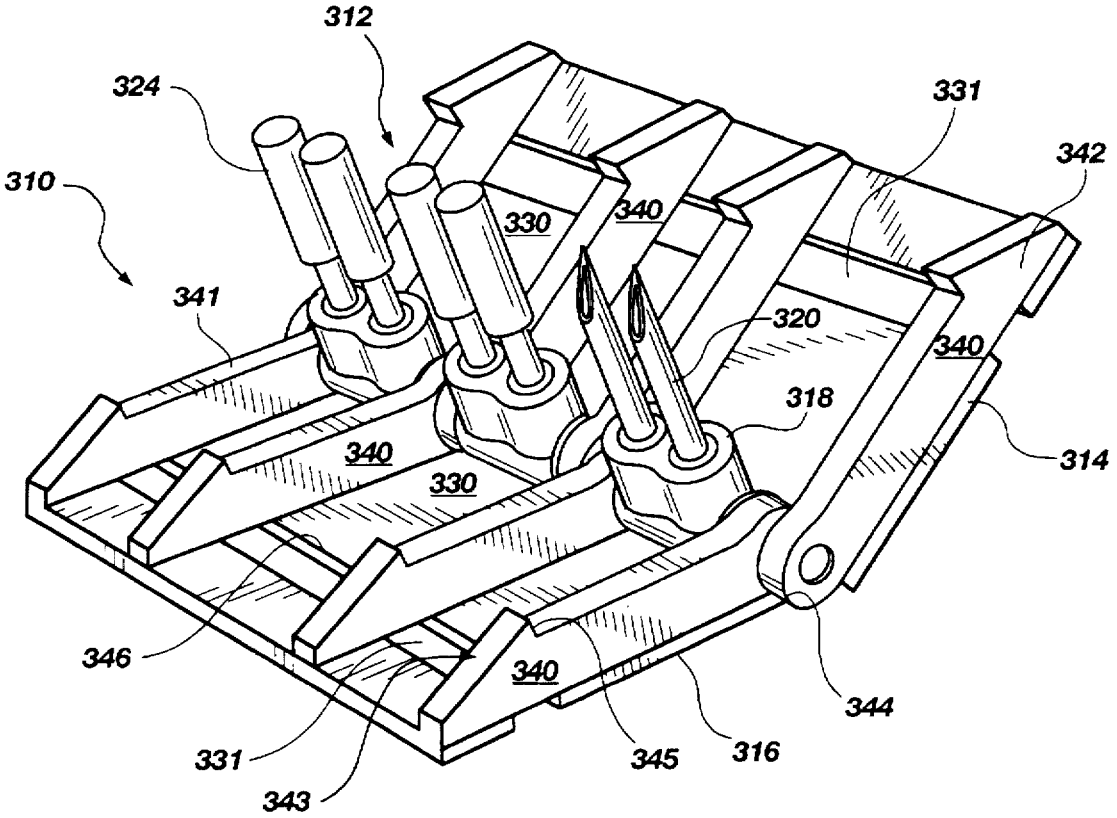
FIG. 7 is a perspective view of a second alternate preferred embodiment of the compact tire deflator.

As illustrated in FIG. 7, a second alternate preferred embodiment of the compact tire deflator 310 of the present invention includes a compact housing member 312 having a first panel 314 pivotally disposed in relation to a second opposing panel 316. Similar to the embodiment shown in FIG. 1, the housing member 312 comprises an intermediate portion 330 providing an internal surface area being sufficient for housing at least one spike mounting assembly 318.

The first and second panels 314, 316 of the housing member 312 may each include one or more structural ribs 340, with each rib having a distal end 342 and a proximate end 344. The structural ribs 340 provide a means for defining one or more internal cavities 346 in relation to the interior surface of the first and second panels 314, 316. The internal cavity 346 may be formed having an internal periphery comprising a sufficient dimensional surface area wherein at least one spike mounting assembly 318 and one or more removably mounted hollow spikes 320 may be pivotally disposed and removably housed when the housing member 312 is operably disposed in a closed position.

In structural relationship, because the presently preferred embodiment shown in FIG. 1 and the alternate embodiment shown in FIG. 7 are relatively constructed having a substantially comparable configuration, only the structural differences will be operatively disclosed in detail herein Whereas, any structural variation(s) which exist between the embodiment of FIG. 1 and the alternate embodiment of FIG. 7 will be further disclosed, whereby noting such variation(s).

In one presently preferred alternate embodiment of the present invention as illustrated in FIG. 7, a shoulder 343 may be disposed at the distal end 342 of each rib 340. The shoulder 343 is preferably formed having an angular disposition and including a protruding portion 345 which may extend beyond the upper surface of the inclined ramp 341 of the rib 340. In operation, a pneumatic tire 96 rolls toward the compact tire deflator 310 and engages one or more shoulders 343, depressing the engaged shoulders 343 into the surface on which the deflator 310 is deployed. As the tire 96 continues to roll on or over the first panel 314 or the second panel 316, the housing member 312 cants towards the rolling tire 96 thus directing one or more hollow spikes 320 into the tire 96 to allow the air retained therein to vent at a controlled rate of deflation. After the tire 96 has been punctured, the tire may continue to roll toward and engage the shoulder 343 opposing the initially engaged shoulder 343 formed in the opposing panel 320, 322 of the housing member 312.

In structural configuration, the shoulders 343 are preferably sized and angularly disposed in such a manner so as to urge the pivotal engagement away from the tire 96 in order to withdraw the spike 320 from the deflator 310, thereby leaving the spike 320 embedded in the tire. Thus, as the tire rolls off the shoulder 343 and effectively off the tire deflator 310, the tire may retain the spike 320 therein, while preferably leaving the compact tire deflator 310 on the surface.

To facilitate a means for housing at least one spike mounting assembly 318 and one or more spikes 320 removably disposed in relation to the housing member 312, a receiving channel 331 may be formed in the intermediate portion 330 of the first and second panels 314, 316. The receiving channel 331 may be formed such that when the first and second panels 314, 316 of the housing member 312 are disposed in a closed position, the protruding portion 345 of the opposing shoulder 343 may be substantially positioned therein. Specifically, when the housing member 312 is arranged in a closed position, the protruding portion 345 of a shoulder 343 of the first panel 314 is substantially disposed within the receiving channel 331 of the second panel 316. Similarly, the protruding portion 345 of a shoulder 343 of the second panel 316 is substantially disposed within the receiving channel 331 of the first panel 314, when the first and second panels 314, 316 are arranged in the closed position.

In current design, the receiving channel 331 preferably comprises an elongated channel formed in the first and second panels 314, 316 and having a dimensional internal periphery sufficient for receiving the protruding portions 345 of one or more shoulders 343. It will be apparent that other receiving means may be constructed in accordance with the inventive principles set forth herein. For example, the receiving channel 331 may be replaced with apertures, slits, or the like. It is intended, therefore, that the examples provided herein be viewed as exemplary of the principles of the present invention, and not as restrictive to a particular structure for implementing those principles.

Figure 4:
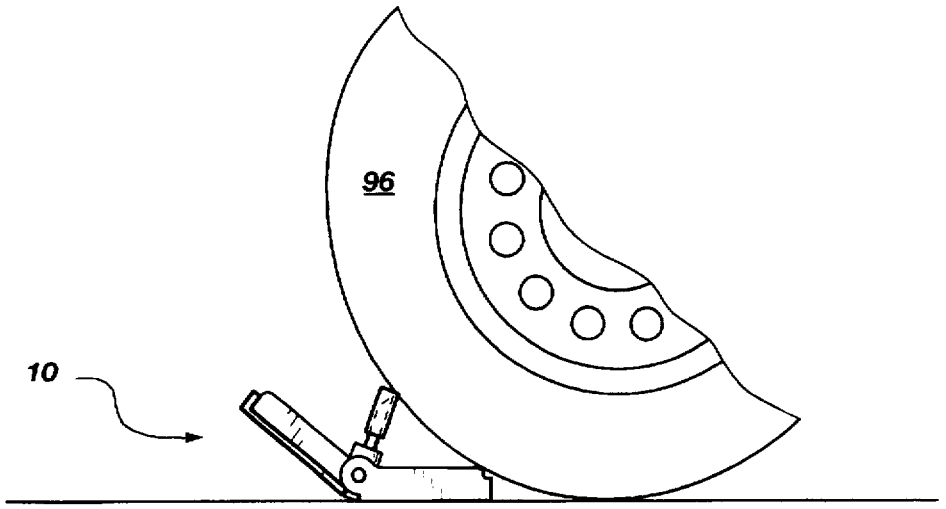
FIG. 4 is a side elevational view of one presently preferred embodiment of compact tire deflator illustrating a hollow spike engageably disposed in relation to a pneumatic tire.

Referring back to FIG. 5 and consistent with one presently preferred embodiment of the present invention, the first panel 14 and the second opposing panel 16 of the housing member 12 may be pivotally disposed about the pivot pin 80 of the pivotal engagement 22 such that the compact tire deflator 10 of the present invention may be operably disposed in a closed position. Correspondingly, the first panel 14 and the second opposing panel 16 of the housing member 12 may be pivotally disposed about the pivot pin 80 of the pivotal engagement 22 such that the compact tire deflator 10 may be operably disposed in an open position, thereby exposing the hollow spikes 20 for penetrating a pneumatic tire 96 of a vehicle, as illustrated in FIGS. 1, 3 and 4.

In preferred construction, the compact tire deflator 10 the present invention will only open to a predetermined angular disposition which is substantially determined by a structural stop 62 disposed in relation to the spike mounting assembly 18. Preferably, the structural stop 62 of the spike mounting assembly 18 protrudes substantially outward from the base 50 of the spike mounting assembly 18 thus providing a means for engaging the second sides 36 of both the first and second panels 14, 16. In this regard, the structural stop 62 interrupts the pivotal disposition of the first and second panels of the housing member 12 whereby angularly disposing the first and second panels 14, 16 in relation to the spike mounting assembly 18. In this position, the structural ribs 40 of the first panel 14 and the second panel 16 provide an inclined ramp 41 upon which a tire 96 rolling thereover may travel.

The compact tire deflator 10 of the present invention may also comprise an interlocking means (not shown) which includes a structural locking member interacting with one or more structural stops 62 of the spike mounting assemblies 18 to provide structural resistance when disposing the housing member 12 from an open position to a closed position, and vice versa. It is apparent that several conventional mechanisms or structural enhancements may be constructed or incorporated in accordance with the inventive principles set forth herein which are possible to achieve the foregoing interlocking function, if desired.

In preferred operation of one presently preferred embodiment of the present invention, the angular disposition of the first and second panels 14, 16 of the housing member 12 in relation to the spike mounting assembly 18 is sufficient to provide a means for actuating a rocking motion when a tire 96 rolls on or over the first panel 14 or the second panel 16, whereby the housing member 12 preferably cants towards the rolling tire 96 thus directing the tip 70 of one or more hollow spikes 20 into the pneumatic tire 96 to allow the air retained within the tire to vent, allowing the driver to stop the vehicle in a controlled manner.

The angular disposition between the first panel 14 and the second opposing panel 16 of the housing member 12 preferably comprises an angle of between approximately 90° and 160°, and preferably about 140°. Correspondingly, the first and second panels 14, 16 of the housing member 12 comprise an angular disposition in relation to a supporting surface (e.g., driveway, roadway, etc.) of between approximately 10° and 45°, and preferably about 20°.

From the above discussion, it will be appreciated that the present invention provides a novel compact tire deflator which provides for the controlled deflation of at least one pneumatic tire of a vehicle driven thereover. Further, the present invention provides a compact tire deflator which is inherently compact, light weight and conveniently portable. Similarly, the present invention simplifies the tire deflating process, is relatively trouble free in operation, and comprises few moving parts.

Unlike prior art devices, the present invention is capable of protecting a user from personal injury as a result of being impaled by one or more spikes, irrespective of whether the compact tire deflator of the present invention is deployed for operation, thrown by a vehicle, or retained for storage. In addition, the present invention comprises a tip guard for protecting the respective tip of the hollow spikes. Moreover, the apparatus and techniques of present invention can be immediately used without prior assembly and can generally disable a vehicle regardless of the direction of travel.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A deflator for tires, said deflator comprising:

a pivotal engagement;

a mounting assembly having at least one aperture extending a first depth and a first diameter, said mounting assembly providing means for pivotally engaging said pivotal engagement;

a spike disposed in said aperture of said mounting assembly, said spike having a second diameter less than said first diameter;

a housing member comprising a first panel and a second opposing panel disposed in relation to said pivotal engagement, said first and second panels being selectively pivotable into an open position, said open position providing a structural support for angularly disposing said housing member in relation to said mounting assembly; and said housing member being selectively pivotable into a closed position, wherein at least one of said panels of said housing member comprises an internal surface area being dimensionally sufficient for disposing said mounting assembly and said spike.

2. A deflator as defined in claim 1 further comprising a sleeve positionable around said spike for disposition in said aperture, wherein said sleeve provides means for resisting distortion of said mounting assembly upon deflection of the spike.

3. A deflator as defined in claim 2 wherein said sleeve consists of a resilient substance capable of withstanding shock without permanent deformation.

4. A deflator as defined in claim 1 further comprising a tip guard adapted to receive an upper portion of said spike.

5. A deflator as defined in claim 4 wherein said tip guard comprises an elongated tubular member having an open end, an opposing closed end, and a hollow intermediate section disposed therebetween.

6. A deflator as defined in claim 4 wherein said tip guard comprises a material being sufficiently pierceable by said spike.

7. A deflator as defined in claim 1 wherein said pivotal engagement comprises a pivot pin.

8. A deflator as defined in claim 7 wherein said pivot pin comprises a sufficiently rigid material providing means for resisting longitudinal movement in response to a force exerted on said spike.

9. A deflator as defined in claim 1 further comprising a plurality of mounting assemblies pivotally disposed in relation to said pivotal engagement.

10. A deflator as defined in claim 1 wherein said mounting assembly comprises a spike seat having an opening formed therein for introducing said pivotal engagement.

11. A deflator as defined in claim 10 wherein said spike seat further comprises at least one channel, said channel having a third diameter sized to receive a base end of said spike.

12. A deflator as defined in claim 1 wherein said spike comprises a channel having an internal diameter sized to conduct air.

13. A deflator as defined in claim 1 wherein said first and second panels include at least one shoulder adapted to receive a tire thereon.

14. A deflator as defined in claim 13 wherein said shoulder being sized and angularly disposed to urge said pivotal engagement away from said tire for withdrawing with the tire said spike from said mounting assembly as the tire moves away from the pivotal engagement.

15. A deflator as defined in claim 13 wherein said first and second panels comprise a receiving channel for receiving said shoulder when said housing member is selectively disposed into said closed position.

16. A deflator as defined in claim 1 wherein said internal surface area comprises a sufficient dimensional periphery wherein at least one spike mounting assembly having at least one removably disposed spike may be positioned when said housing member is selectively disposed into said closed position.

17. A compact deflator for tires, said deflator comprising:

a pivotal engagement;

a mounting assembly having at least one aperture extending a first depth and a first diameter, said mounting assembly providing means for pivotally engaging said pivotal engagement;

a hollow spike removably disposed in said aperture of said mounting assembly, said spike having a second diameter less than said first diameter;

a housing member comprising a first panel and, a second opposing panel disposed in relation to said pivotal engagement, said first and second panels being selectively pivotable into an open position, said open position providing a structural support for angularly disposing said first panel in relation to said second panel;

said housing member being selectively pivotable into a closed position, wherein said first and second panels of said housing member comprise an internal surface area being dimensionally sufficient for disposing said mounting assembly and said spike therein; and a sleeve positionable around said spike to fit in said aperture to resist distortion of said mounting assembly upon deflection of the spike.

18. A compact deflator as defined in claim 17 further comprising a plurality of said mounting assemblies pivotally disposed in relation to said pivotal engagement.

19. A compact deflator as defined in claim 17 further comprising a tip guard adapted to receive an upper portion of said hollow spike.

20. A compact deflator as defined in claim 17 wherein said angular disposition of said first panel in relation to said second panel provides a means for engaging said tire.

21. A deflator as defined in claim 17 wherein said first and second panels include at least one shoulder adapted to receive a tire thereon.

22. A deflator as defined in claim 21 wherein said shoulder being sized and angularly disposed to urge said pivotal engagement away from said tire for withdrawing with the tire said spike from said mounting assembly as the tire moves away from the pivotal engagement.

23. A deflator as defined in claim 21, wherein said first and second panels comprise a receiving channel for receiving said shoulder when said housing member is selectively disposed into said closed position.

* * * * *

UNITED STATES PATENT AND TRADEMARK OFFICE

CERTIFICATE OF CORRECTION

PATENT NO. : 5,775,832
DATED : July 7, 1998
INVENTOR(S) : Kilgrow et al.

It is certified that error appears in the above-identified patent and that said Letters Patent is hereby corrected as shown below:

In column 9, line 54, delete "60", and insert therefor -- 60 --.

In column 12, line 11, after "herein", please insert -- . --.

In column 16, line 4, delete "and,", and insert therefor -- and --.

Signed and Sealed this

Twenty-second Day of September, 1998

*Attest:*

*Attesting Officer*

BRUCE LEHMAN

*Commissioner of Patents and Trademarks*